United States Patent [19]

Gatley et al.

[11] Patent Number: 4,654,968

[45] Date of Patent: Apr. 7, 1987

[54] KNIFE SHARPENERS

[75] Inventors: Derrick R. Gatley, Reading; David S. Duncan, London, both of England

[73] Assignee: Wilkinson Sword Limited, High Wycombe, England

[21] Appl. No.: 807,398

[22] Filed: Dec. 10, 1985

[30] Foreign Application Priority Data

Dec. 13, 1984 [GB] United Kingdom ..... 8431456
Nov. 26, 1985 [GB] United Kingdom ..... 8529042

[51] Int. Cl.[4] ..... B24B 3/54
[52] U.S. Cl. ..... 30/138; 76/86
[58] Field of Search ..... 76/82, 86, 88; 30/138, 30/139, 151; 51/204, 214, 211

[56] References Cited

U.S. PATENT DOCUMENTS

| | | | |
|---|---|---|---|
| 2,416,929 | 3/1947 | Kjorsvik | 30/138 |
| 3,339,313 | 9/1967 | Lindhag | 51/205 WG |
| 4,041,651 | 8/1977 | Bayly | 76/82 |
| 4,494,339 | 1/1985 | Pittaway | 76/82 |

*Primary Examiner*—Roscoe V. Parker
*Attorney, Agent, or Firm*—John K. Williamson

[57] ABSTRACT

A knife sharpener comprises a scabbard 10 for receiving a knife blade 13. A sharpening device 11 is carried within the scabbard to engage a blade edge 14 within the scabbard 10 and can be moved manually along the scabbard to sharpen the blade edge 14. Thus, sharpening is accomplished while the blade is within the scabbard. A locking device 31 is provided to hold the blade within the scabbard 10. Part 46 of the scabbard 10 may be displaced to allow the sharpening device 11 to be removed for cleaning.

14 Claims, 9 Drawing Figures

KNIFE SHARPENERS

BACKGROUND OF THE INVENTION

1. Field of the Invention

The invention relates to knife sharpeners in which a scabbard is provided for receiving a knife blade and in which a sharpening device is included for sharpening an edge of the knife blade.

2. Review of the Prior Art

In previously proposed sharpeners of this kind, the sharpening action has been achieved on withdrawal of the knife from the scabbard with the knife edge engaging a fixed sharpening device carried on the scabbard. Although such a knife sharpener is effective in sharpening the blade edge, it has the disadvantage of a sharp edge emerging from the scabbard during, and as part of, the sharpening action. Such a sharp edge emerging in these circumstances presents a danger both to the person withdrawing the knife blade and to objects, such as work surfaces, which are immediately adjacent the emerging blade edge, both of which can be cut by the freshly sharpened edge.

SUMMARY OF THE INVENTION

According to the invention, there is provided a knife sharpener comprising a scabbard for receiving a blade of a knife and a sharpening device carried by the scabbard and being movable relatively to the scabbard to pass with a sharpening action along an edge of a blade within the scabbard.

It is a further disadvantage of the previously proposed sharpeners referred to above that the blade is usually withdrawn from the scabbard in a straight line. Where the blade has an edge which is straight adjacent the handle but curved at the tip, this can result in sharpening of the straight edge only, with the curved edge remaining unsharpened.

According to a preferred embodiment of the invention, the sharpening device is constrained by the scabbard to move in a path in which the device contacts the whole length of the blade edge.

It is a yet further disadvantage of some of the previously proposed sharpeners referred to above that the blade is always sharpened on extraction from the scabbard.

Sharpening may not, however, be required with this frequency.

In a further embodiment of the invention, the sharpening device may be movable into and out of engagement with a blade edge within the scabbard.

The invention also includes within its scope a sharpening device of any of the kinds referred to above in combination with a knife having a blade received within the scabbard.

BRIEF DESCRIPTION OF THE DRAWINGS

The following is a more detailed description of one embodiment of the invention, by way of example, reference being made to the accompanying drawings in which.

DESCRIPTION OF THE PREFERRED EMBODIMENTS

Figures 1, 9:
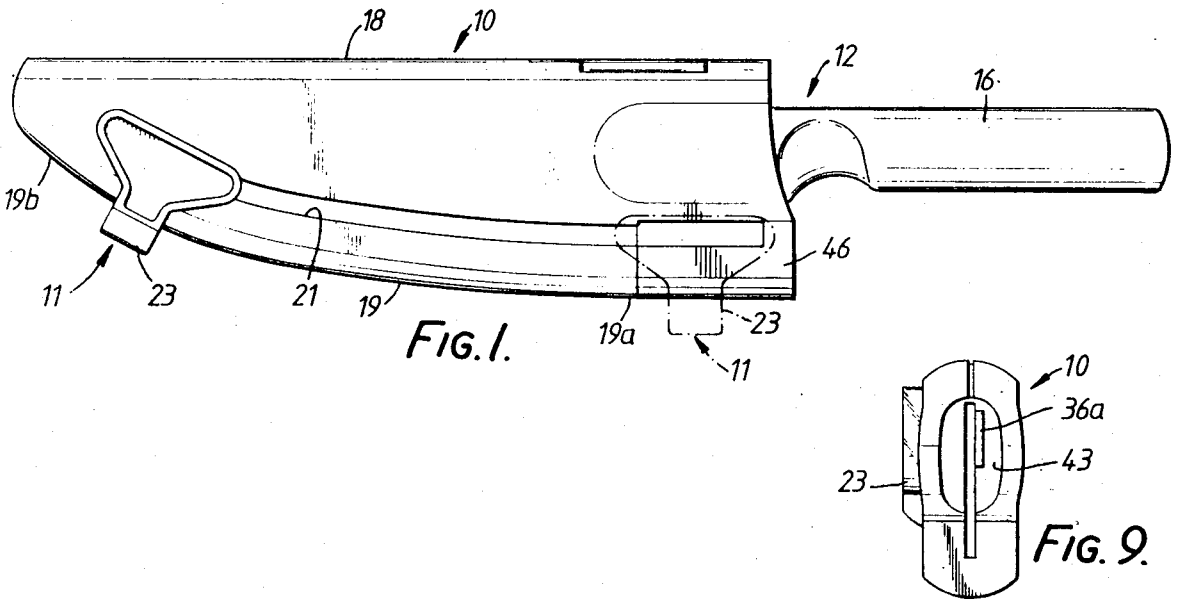
FIG. 1 is a side elevation of a scabbard and a sharpening device of a knife sharpener and showing a knife blade inserted into the scabbard.
FIG. 9 is an end elevation of the scabbard as seen from the handle end of the scabbard.

The sharpener comprises a scabbard 10 and a sharpening device 11. The scabbard is shaped to provide a pasasage for receiving a knife 12 having a blade 13 with a cutting edge 14 and a back edge 15 (see FIG. 4), and a handle 16. The cuttig edge 14 has a nearly straight portion leading from the handle to a more highly curved portion which terminates at the tip of the blade.

Figure 3:
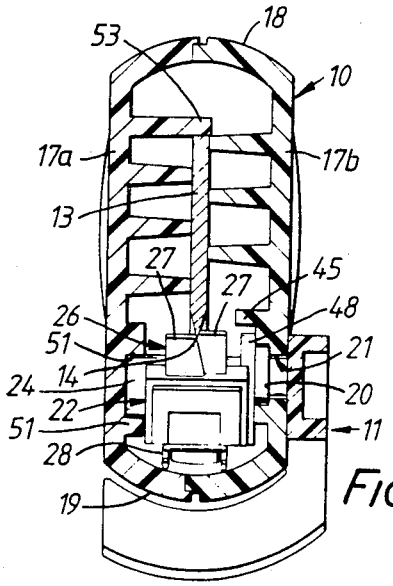
FIG. 3 is a cross-section through the knife scabbard on the line III—III of FIG. 2 and showing the sharpening device.
Figure 6:
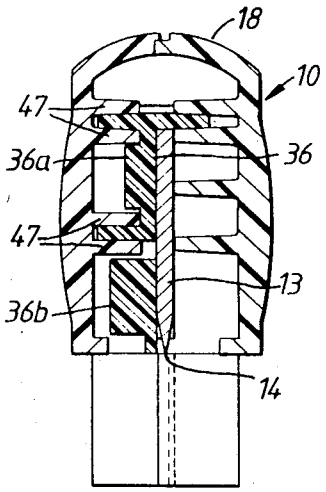
FIG. 6 is a section on the line VI—VI of FIG. 4.

The scabbard 10 is formed from any suitable metal, wooden or plastics material, but most conveniently it is moulded from a plastics material. As best seen in FIG. 3, the scabbard 10 is of generally rectangular cross-section with two parallel side walls 17*a*, 17*b*, a top wall 18, and a bottom wall 19 which follows the curvature of the blade edge i.e. it has a nearly flat portion 19*a* which is followed by and merges with a more highly curved portion 19*b* (see FIG. 1).

One side wall 17*b* is formed with a slot 21 (see FIGS. 1 to 3) extending along the length thereof. A guide rib 45 runs along and parallel to the length of the slot 21 for a purpose to be described below.

As best seen in FIG. 1, the scabbard 10 is formed with a removable part 46 adjacent the open end of the scabbard 10 and formed by lower parts of the side walls 17, containing an end of the slot 21, and a portion of the bottom wall 19. This removable part thus forms a removable U-shaped carrier whose purpose will be described below. The carrier 46 may be provided with grooves which engage corresponding rails on the remainder of the scabbard 10 to allow the carier 46 to be slid into and out of engagement with the remainder of the scabbard 10.

Figure 2:
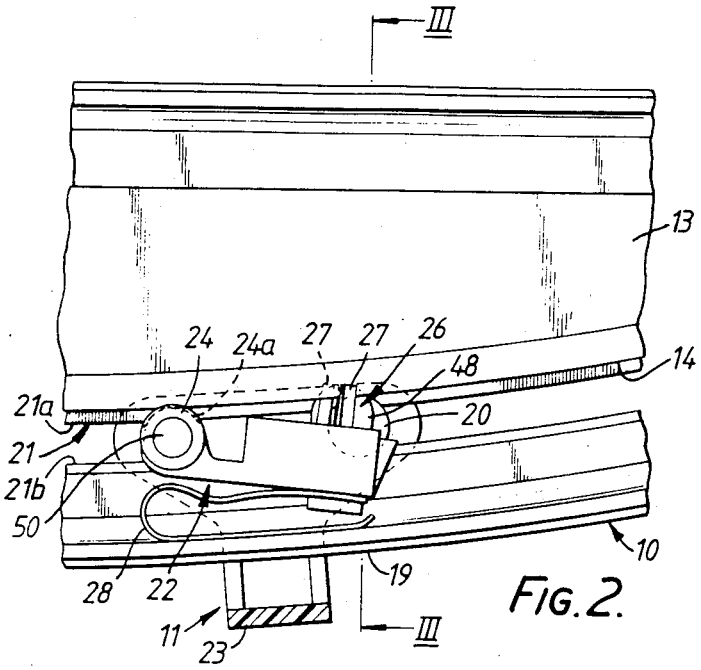
FIG. 2 is a longitudinal section through part of the knife blade and scabbard showing the sharpening device in its sharpening mode.

The sharpening device 11, which is best seen in FIGS. 2 and 3, includes a carriage 22 mounted within the scabbard and shaped to be slidable in engagement with the inside face of the side wall 17*b*. The carriage 22 is of generally rectangular cross-section and has formed thereon, at the end thereof closer to the entrance to the scabbard 10, a hollow bush 24 formed with a guide slot 24*a* which cleans the cutting edge 14. The bush 24 receives a rod 50 (see FIG. 2) which engages in the slot 21 and is integral with a slider 23 of the sharpening device so that the carrier 22 is mounted on the slider 23 for pivotal movement about the rod 50. An end of the bush 24 remote from the slider 23 engages between two flanges 51 formed on the side wall 17*a*, which thus guide the carriage 22 in sliding movement.

The slider 23 engages the outer face of the side wall 17*b* and extends downwardly before turning under the scabbard 10 to form a handle for moving the carriage 22 along the slot 21. The other end of the slider 23 is provided with a boss 20 which also engages in the slot 21 to guide the slider 23.

A sharpener is located at the end of the carriage remote from the entrance to the scabbard 10 and comprises two or more sharpening plates 27 or the like, which are fixed on the carriage 22 and which extend transversely to the direction of movement of the carriage. The plates 27 define between them a V-shaped slot for engagement with the cutting edge 14 of the blade. These plates 27 can be of tungsten carbide or other blade sharpening material, or can be replaced by any other suitable form of knife sharpening device.

Adjacent the plates 27 is a stop 48 which engages the guide rib 45 to limit the pivoting movement of the carriage 22 towards the blade edge 14*a*.

A U-shaped spring 28 is secured at one end to the carriage 22 and at its opposite end engages the bottom wall 19 of the scabbard 10 to tend to pivot the sharpener relative to the slider 23 into contact with the cutting edge 14 of the knife blade.

Since the movement of the sharpening device 11 along the cutting edge 14 is in a sense to pull the scabbard off the knife, if the latter were held by the handle, a releasable locking device 31 is provided to lock the knife within the scabbard.

The locking device, as seen in FIGS. 4 to 8, comprises a press-button 32 movable between a raised (see FIG. 4) and a depressed (see FIG. 7) position in a slot 33, formed in the upper wall 19 of the scabbard 10. A plate 34, which is formed integrally with, and depends from, the press-button 32, is provided with a cut-out 35 of inverted L-shape. The plate 34 lies to one side of the knife blade 13.

Figure 4:
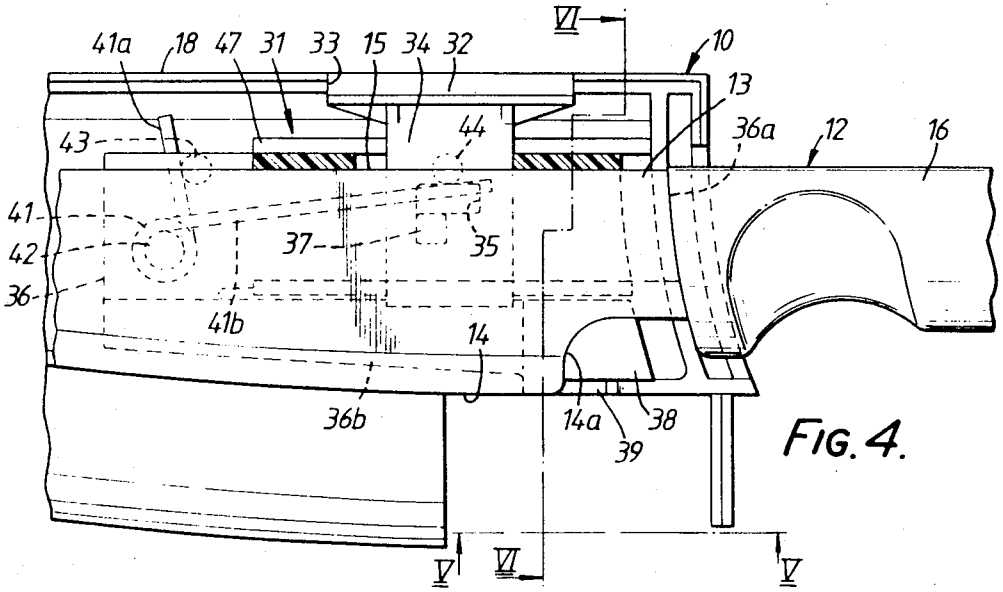
FIG. 4 is a longitudinal section through part of the knife and scabbard, with a carrier of the scabbard removed for clarity, illustrating means for locking the knife in the scabbard and showing the knife in its locked position.
Figure 5:
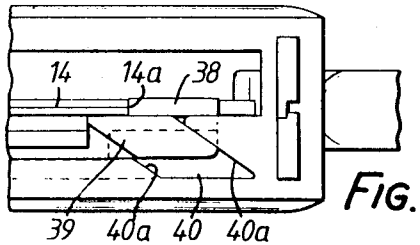
FIG. 5 is a view from beneath of the part of the knife and scabbard shown in FIG. 4, on the line V—V of FIG. 4, and showing the engagement of the locking means with the knife.
Figure 7:
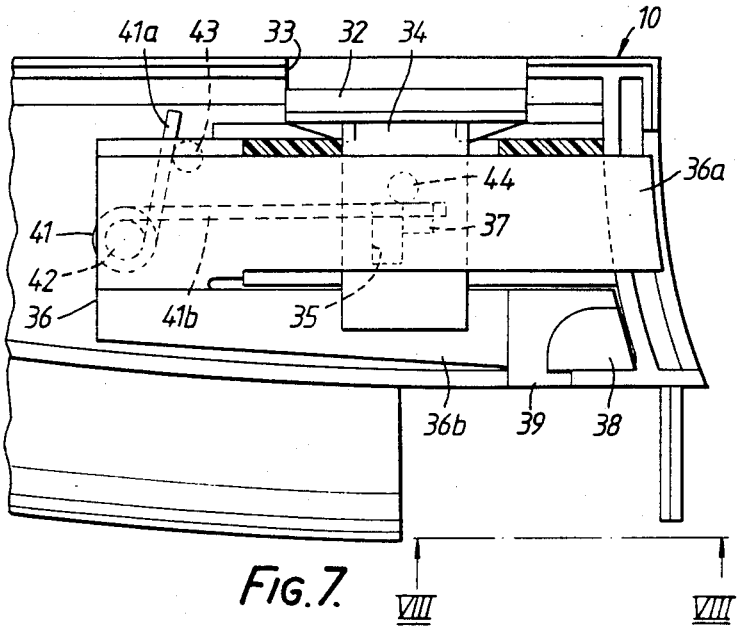
FIG. 7 is a similar view of FIG. 4 but showing the scabbard with the knife removed.
Figure 8:
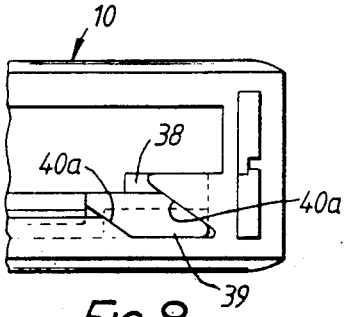
FIG. 8 is a view from beneath of the part of the scabbard shown in FIG. 7, on the line VIII—VIII of FIG. 7, showing the locking means disengaged from the knife.

A U-shaped slide 36 is guided by flanges 47 formed on the interior of the scabbard 10 (see FIG. 6) to be movable horizontally between an extended inoperative position (shown in FIG. 7) and a retracted operative position (shown in FIG. 4). An upper limb 36*a* of the slide 36 carries a pin 37 intermediate its ends which engages in the cut-out 35 on the plate 34. The free end 36*a* of this upper limb extends from the scabbard 10, in the extended position of the slide 36. A lower limb 36*b* of the slide 36 carries at its free end a segment-shaped pawl 38 and a cam block 39 which is of generally trapezoidal section (see FIGS. 5 and 8) and which is received in a complementarily shaped cam slot 40 formed in a lower part of the side wall 17*a*. The slot 40 lies in a plane normal to the plane of the knife blade 13 and to one side of the blade. The slot 40 has side walls 40*a* which, when viewed as in FIGS. 4 and 8, have a reverse slant relative to the blade 13.

A torsion spring 41 is carried on a peg 42 formed on the interior of the scabbard 10 and has two arms 41*a*, 41*b*, one of which, 41*a*, engages a lug 43 on the slider 36 to urge the slider 36 towards the extended position and the other of which, 41*b*, engages a lug 44 on the plate 34 to urge the press-button 32 into raised position.

When the knife blade 13 is within the scabbard 10 (see FIGS. 4 and 5), the press-button 32 is in the raised position, under the action of the spring 41, and the slider 36 is in the retracted position, in which it is held against movement by the spring 41 by engagement of the pin 37 in the vertical limb of the cut-out 35. The cam block 39 is forced, by the reverse slant of the slot 40, out of the slot 40 (see FIG. 5) to position the pawl 38 in a complementarily shaped cut-out 14a provided in the knife edge 14 adjacent the handle. Thus the knife 12 is positioned in the scabbard 10 with the handle 16 forced into the entrance of the scabbard 10 and the back edge 15 of the blade forced into engagement with part of the slide 36 (see FIGS. 4 and 6) and with a flange 53 provided in the scabbard 10 (see FIG. 3).

To remove the knife 12 from the scabbard 10, the pressbutton is depressed. This moves the L-shaped cut-out 35 downwardly, thus allowing the pin 37 to enter the horizontal arm of this cut-out 35. The slide 36 is thus released for movement by the spring 41 to the extended position, during which movement, the cam block 39 is forced into the slot 40 so moving the pawl 38 out of engagement with the cut-out 14*a* on the knife blade. At the same time, the free end of the upper limb 36*a* of the slide is extended out of the scabbard 10, so pushing the handle 16 out of the scabbard to commence removal of the knife from the scabbard 10. This removal is then continued manually to effect complete removal.

In order to sharpen the blade edge 14, the knife blade is inserted into the scabbard 10. As the blade 13 is almost wholly within the scabbard 10, the handle engages the projecting end of the upper limb 36*a* of the slide 36 and continued insertion of the blade 13 causes the slide to be moved against the spring force to the retracted position. This movement cams the block 39 out of the slot 40 and so engages the pawl 39 with the cut-out 14*a* to hold the knife in the scabbard 10. In addition, the pin 37 is moved into alignment with the vertical limb of the cut-out 35, so allowing the press-button 32 to be raised by the spring 41 and re-triggered for releasing movement.

The sharpening device 11, when in the retracted position shown in chain line in FIG. 1, may either be out of engagement with the blade edge or may be in light engagement with the blade edge. This is determined by appropriate arrangement of the position of the guide rib 45 in relation to the blade edge 14*a*. When at rest the sharpening device can be located in the position shown in chain line in FIG. 1, i.e. adjacent the open end of the scabbard, or at the tip as shown in full line in FIG. 1, or at an intermediate position.

Manual pressure is then applied to the slider 23 to cause it to move along the slot 21 from the handle end to the tip end of the blade. The pressure of the U spring 28 urges the sharpening blades 27 into sharpening engagement with the cutting edge 14 and the movement along the slot 21 passes the sharpening device along the cutting edge. The shape of the sharpening blades 27 may be so arranged that, in one direction of movement, the blades 27 may sharpen the blade 14 and, in the opposite direction, they may hone the blade. The correspondence of the shape of the slot 21 with the shape of the cutting edge ensures that both the relatively straight portion of the blade edge and the curved portion of the blade edge are satisfactorily sharpened and also ensures that the sharpening device maintains the same or similar attitude to the blade edge throughout its movement.

Thus the cutting edge 14 of the blade is sharpened (and honed) while it is still within the scabbard 10. This mans that the edge 14 is completely protected during such sharpening so that there is no danger to the user or to surrounding objects during the sharpening action.

After sharpening has been completed, which may be by one or a number of movement of the sharpening device 11 to-and-fro along the slot, the locking device 31 is released and the blade 14 is withdrawn from the scabbard ready for use.

If the sharpening device 11 is located at rest near the blade tip, the blade can be inserted into and withdrawn from the scabbard without being sharpened. There is no danger, therefore, of the blade edge 14 being oversharpened. As mentioned above, the disposition of the guide rib 45 may be such that, when the sharpening device is in the position shown in chain line in FIG. 1, the sharpening device is retracted out of engagement with the blade so that no sharpening is effected by withdrawing the blade from the scabbard. When in this position the removable scabbard carrier 46 at the open end of the scabbard 10 may be detached from the remainder of the scabbard 10, along with the sharpening device 11, so that the sharpening device 11 can be cleaned and then replaced.

Alternatively, the carrier 10 may be only partly disengaged, to an extent necessary to allow the sharpening device 11 to be removed for cleaning.

The open end of the scabbard is provided with a cuff 43 (see FIG. 9) into which the forward end of the handle fits when the knife is fully inserted into the scabbard. This cuff may be arranged to locate the knife handle accurately relative to the scabbard. Alternatively, location may be achieved by locating the knife on a tray, which can be at least partially withdrawn from the scabbard, and then inserting the tray, with the knife blade, into the scabbard.

If desired, a knife wiper can be mounted in the cuff 43 adjacent the open end of the scabbard to wipe the cutting edge as the knife is withdrawn. Alternatively, or additionally, a leather pad or pad of other material can be provided on the scabbard on which the cutting edge can be stropped. Such a leather pad is preferably removable for cleaning or replacement.

Although the sharpener has been described as including a sharpening device whose position relative to the blade is the same in each direction of movement, a sharpening device could be provided which has different positions relative to the blade in the two opposite directions of movement of the sharpening device.

Although the slider has been described as being movable manually, it will be appreciated that it may be moved by power-operated means.

The scabbard 10 has been described in relation to the knife having a blade edge 14 of a particular curvature. It will be appreciated that a scabbard can be produced to accommodate any required shape of blade edge, including straight blade edges with the sharpening device passing along the whole blade edge.

We claim:

1. A knife sharpener comprising:

a scabbard having two ends, means defining an opening for a knife blade at one of said two ends of the scabbard, means defining a passage within the scabbard for receiving said blade, a movable sharpening device carried by the scabbard, a sharpener included in the sharpening device and for sharpening engagement with an edge of the blade, means included in the sharpening device for moving the sharpening device relatively to the scabbard, means defining a path of said movement of the sharpening device relatively to the scabbard whereby the sharpener passes with a sharpening action along an edge of a blade within the scabbard; and wherein a locking device is provided for holding a knife in the scabbard, to prevent the knife being pushed out of the scabbard during sharpening.

2. A knife sharpener according to claim 1, wherein the path defining means constrain the sharpening device to a path in which the device contacts the whole length of the blade edge.

3. A knife sharpener according to claim 1, wherein the path defining means constrain the scabbard to maintain, at all points along the blade edge, the same or substantially the same attitude to the blade edge.

4. A knife sharpener according to claim 1, wherein the path defining means comprises a guideway which is engaged by the sharpening device.

5. A knife sharpener according to claim 4, wherein the guideway comprises a slot in the scabbard.

6. A knife sharpener according to claim 4, wherein the sharpening device comprises a handle without the scabbard and connected to the sharpener for moving the sharpener along the guideway.

7. A knife sharpener according to claim 1, wherein means are provided for moving the sharpening device into and out of engagement with a blade edge within the scabbard.

8. A knife sharpener according to claim 7, wherein said means for moving the sharpening device into and out of engagement with the blade edge comprises a portion of the path defining means which moves the sharpening device out of engagement with a blade edge within the scabbard when located at said portion.

9. A knife sharpener according to claim 8, wherein said portion is located at least at a tip of a blade edge within the scabbard.

10. A knife sharpener according to claim 8, wherein said portion guides the sharpening device out of engagement with a blade edge within the scabbard.

11. A knife sharpener according to claim 1, wherein the locking device comprises a pawl movable into and out of engagement with a knife blade within the scabbard.

12. A knife sharpener according to claim 11, wherein the pawl is moved into engagement with the knife blade by the action of inserting a knife blade into the scabbard, manually operable means being provided for moving the pawl out of said engagement.

13. A knife sharpener according to claim 12, wherein the locking device comprises a slide carrying the pawl, and having a portion extending from the scabbard, prior to insertion of a knife blade, a knife inserted into the scabbard engaging said portion to move the slide against a spring bias, said movement camming the pawl from said position out of engagement with the knife blade to said position in engagement with said blade, said movement also triggering the manually operable means, operation of said triggered manually operable means effecting return movement of the slide to cam the pawl to said position out of engagement with the blade.

14. A knife sharpener according to claim 1, wherein the sharpening device is detachable from the sharpener for cleaning.

* * * * *